US009302165B2

(12) United States Patent
Chu

(10) Patent No.: US 9,302,165 B2
(45) Date of Patent: Apr. 5, 2016

(54) BASKETBALL NET TESTING DEVICE

(71) Applicant: JIAO HSIUNG INDUSTRY CORP., New Taipei (TW)

(72) Inventor: Keng-Fong Chu, New Taipei (TW)

(73) Assignee: JIAO HSIUNG INDUSTRY CORP., New Taipei (TW)

( * ) Notice: Subject to any disclaimer, the term of this patent is extended or adjusted under 35 U.S.C. 154(b) by 168 days.

(21) Appl. No.: 14/268,941

(22) Filed: May 2, 2014

(65) Prior Publication Data

US 2015/0314179 A1 Nov. 5, 2015

(51) Int. Cl.
*A63B 63/08* (2006.01)
*D04B 21/10* (2006.01)

(52) U.S. Cl.
CPC ..... *A63B 63/083* (2013.01); *D04B 21/10* (2013.01)

(58) Field of Classification Search
CPC ..... A63B 63/083; D04B 21/10
USPC ..... 73/865.8, 159
See application file for complete search history.

(56) References Cited

U.S. PATENT DOCUMENTS 5,456,459 A * 10/1995 Gorman ..... A63B 63/083 473/486
5,681,230 A * 10/1997 Krings ..... A63B 69/0071 124/26
5,776,018 A * 7/1998 Simpson ..... A63B 24/0021 473/433
5,842,699 A * 12/1998 Mirando ..... A63B 63/06 273/317.3
7,258,633 B2 * 8/2007 Joseph ..... A63B 63/083 473/422
8,852,030 B2 * 10/2014 Campbell ..... A63B 63/00 473/433

* cited by examiner

*Primary Examiner* — Hezron E Williams
*Assistant Examiner* — Marrit Eyassu
(74) *Attorney, Agent, or Firm* — Ming Chow; Sinorica, LLC

(57) ABSTRACT

A basketball net testing device has a mounting frame, a delivering mechanism, a shooting mechanism, a basketball hoop, a returning mechanism, and a controller. The delivering mechanism has multiple ball seats used for delivering basketballs. The shooting mechanism has a guiding disc and two speeding rollers. The ball seats deliver the basketballs to the guiding disc. The guiding disc guides each of the basketballs to drop between the speeding rollers. The speeding rollers are driven to rotate by a second motor assembly and increase momentum of the basketball. Thus, the basketball is shot into the basketball hoop to rub against a basketball net. Then the basketball drops into the returning mechanism and rolls back into one ball seat of the delivering mechanism in order to be used for testing durability of the basketball net again.

20 Claims, 6 Drawing Sheets

BASKETBALL NET TESTING DEVICE

BACKGROUND OF THE INVENTION

1. Field of the Invention

The present invention relates to a durability testing device, especially to a basketball net testing device that can automatically deliver basketballs and shoot the basketballs through the basketball net to test durability of the basketball net.

2. Description of the Prior Art(s)

Basketball is one of the world's most popular team sports and is played by two competing teams. In a basketball game, each player on a court shoots, passes, blocks, or dribbles a basketball with his two hands. The goal of the offensive team is to shoot the basketball through a basketball hoop to score points. The goal of the defensive team is to disturb and defend the offensive team to prevent the offensive team scoring. The team with the most points at the end of the basketball game wins.

During the basketball game, the basketball is constantly shot through the basketball hoop and rubs a net of the basketball hoop. After being hit and rubbed by the basketball over and over again, the net may be worn out and needs to be replaced with a new one. Therefore, the net is regarded as consumable. Therefore, before manufacturing process of the basketball hoop with the net is accomplished, the basketball has to be shot through the basketball hoop manually so as to test durability of the net.

However, each time when the basketball is shot through the basketball hoop, angles, momentum, and velocities of the basketball are different and cannot be controlled. Therefore, result of durability testing of the net is inaccurate. Moreover, testing durability of the net of the basketball hoop with manually work requires manpower and hence high cost for the manpower.

To overcome the shortcomings, the present invention provides a basketball net testing device to mitigate or obviate the aforementioned problems.

SUMMARY OF THE INVENTION

The main objective of the present invention is to provide a basketball net testing device. The basketball net testing device has a mounting frame, a delivering mechanism, a shooting mechanism, a basketball hoop, a returning mechanism, and a controller. The delivering mechanism has multiple ball seats used for delivering basketballs. The shooting mechanism has a guiding disc and two speeding rollers. The ball seats deliver the basketballs to the guiding disc. The guiding disc guides each of the basketballs to drop between the speeding rollers. The speeding rollers are driven to rotate by a second motor assembly and increase momentum of the basketball. Thus, the basketball is shot into the basketball hoop to rub against a basketball net. Then the basketball drops into the returning mechanism and rolls back into one ball seat of the delivering mechanism in order to be used for testing durability of the basketball net again.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
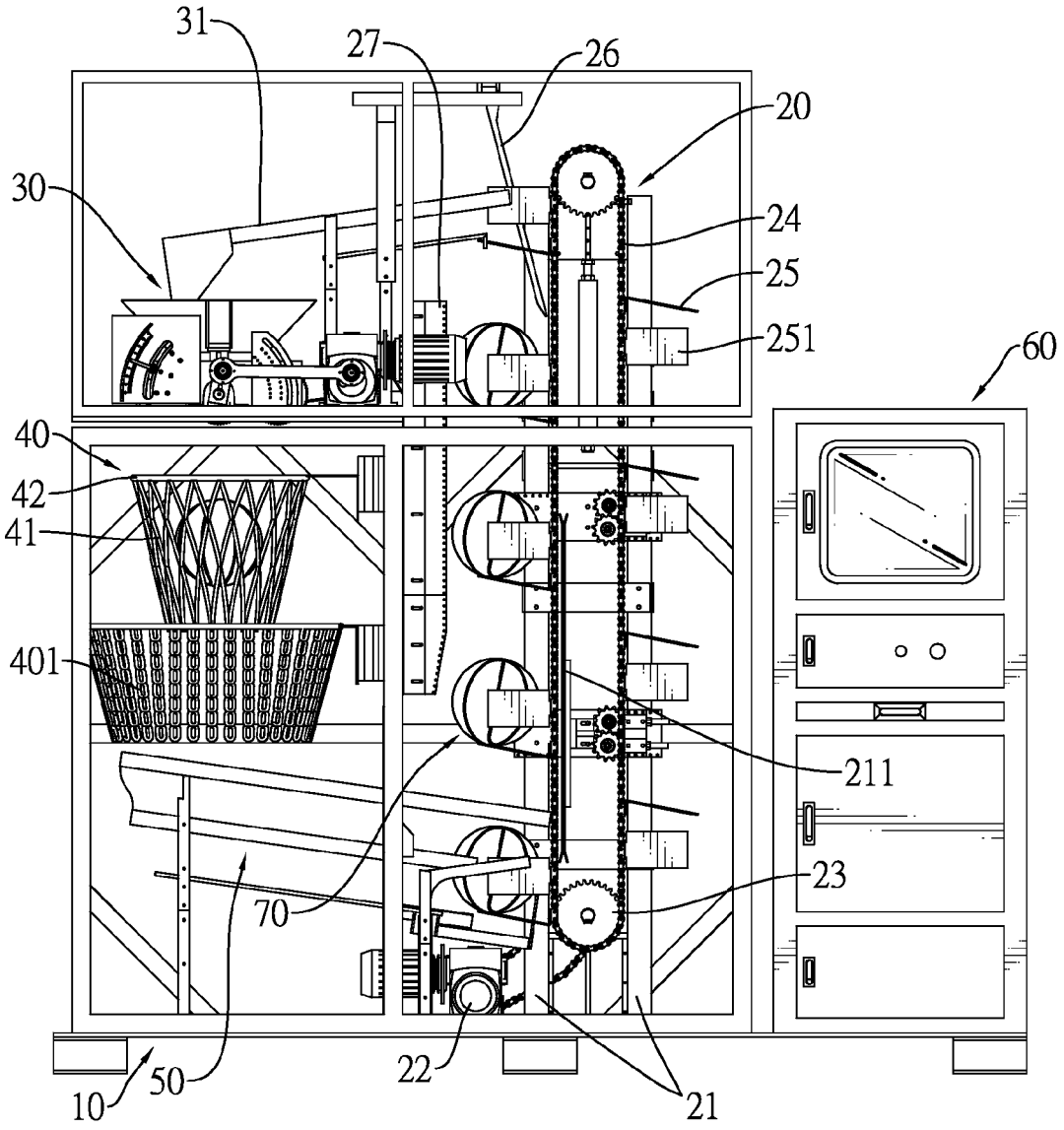
FIG. 1 is a front view of a basketball net testing device in accordance with the present invention.

With reference to FIG. 1, a basketball net testing device in accordance with the present invention comprises a mounting frame 10, a delivering mechanism 20, a shooting mechanism 30, a basketball hoop 40, a decelerating bracket 401, a returning mechanism 50, and a controller 60.

Figure 4:
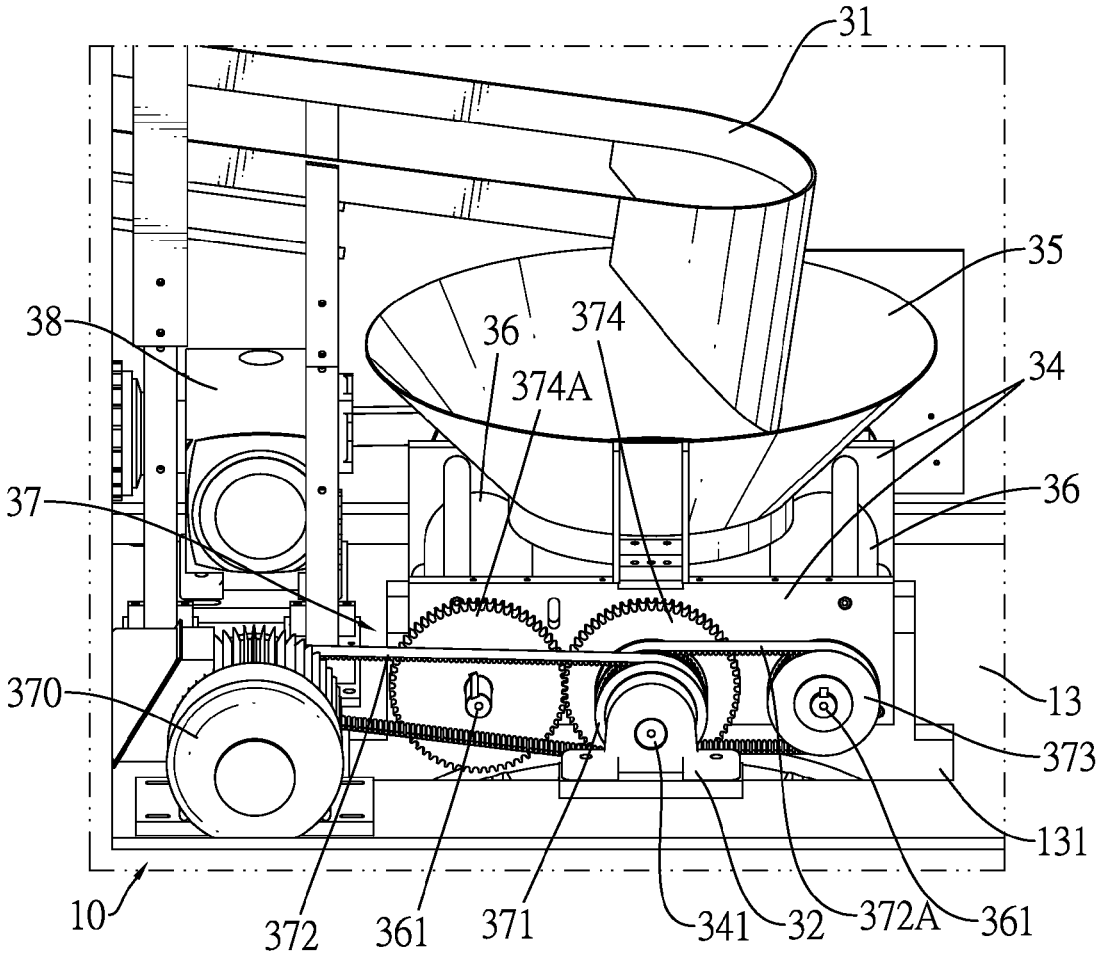
FIG. 4 is a rear view in partial section of a shooting mechanism of the basketball net testing device in FIG. 1.
Figure 6:
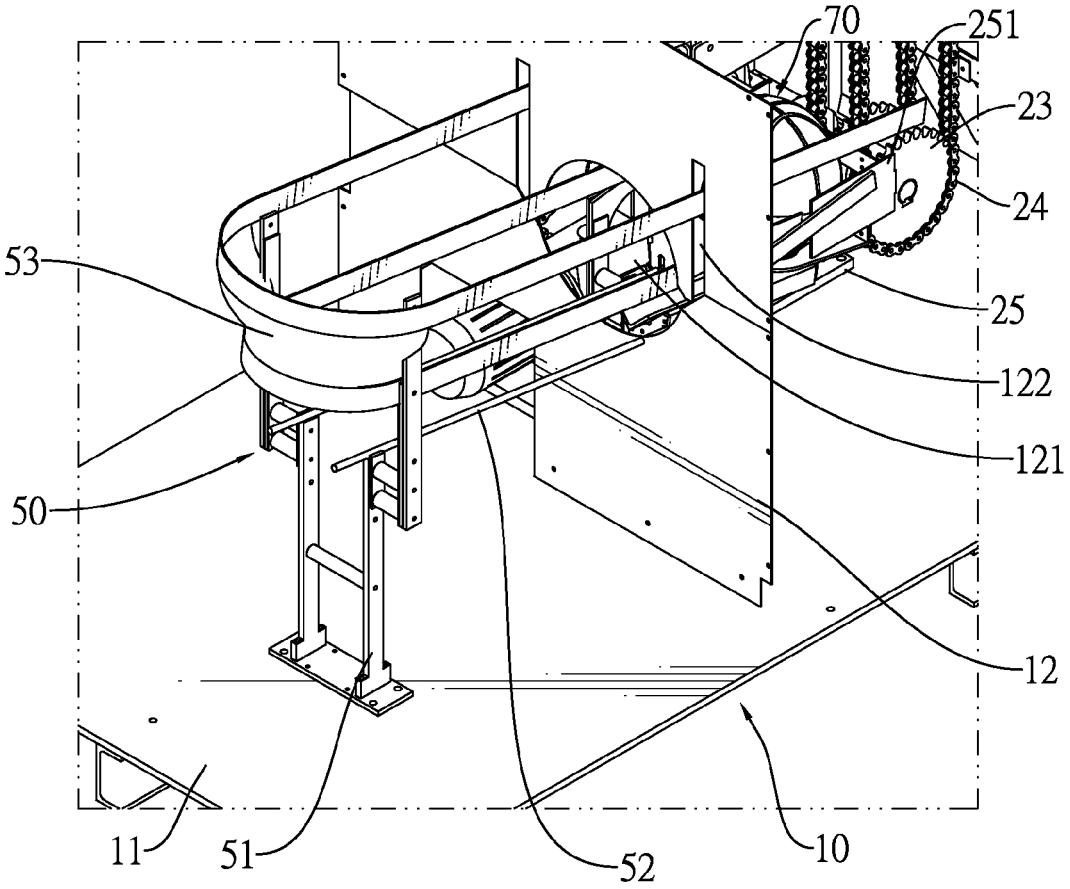
FIG. 6 is a perspective view of a returning mechanism of the basketball net testing device in FIG. 1.

With further reference to FIGS. 1, 4, and 6, the mounting frame 10 is hollow and is formed by assembling multiple supporting rods. The mounting frame 10 has a receiving space, a bottom panel 11, a side panel 12, and a top panel 13. The receiving space is formed in the mounting frame 10. The bottom panel 11 is transversely mounted at a bottom of the mounting frame 10. The side panel 12 is mounted at the bottom of the mounting frame 10 and on the bottom panel 11. The side panel 12 divides the receiving space and has a bottom edge, a returning hole 121 and two longitudinal slots 122. The bottom edge of the side panel 12 is mounted on the bottom panel 11. The returning hole 121 is formed through the side panel 12. The longitudinal slots 122 are formed through the side panel 12 and are respectively disposed oppositely beside the returning hole 121. The top panel 13 is transversely mounted at a top of the mounting frame 10, is parallel to the bottom panel 11, and has an output hole 131. The output hole 131 is formed through the top panel 13.

Figure 2:
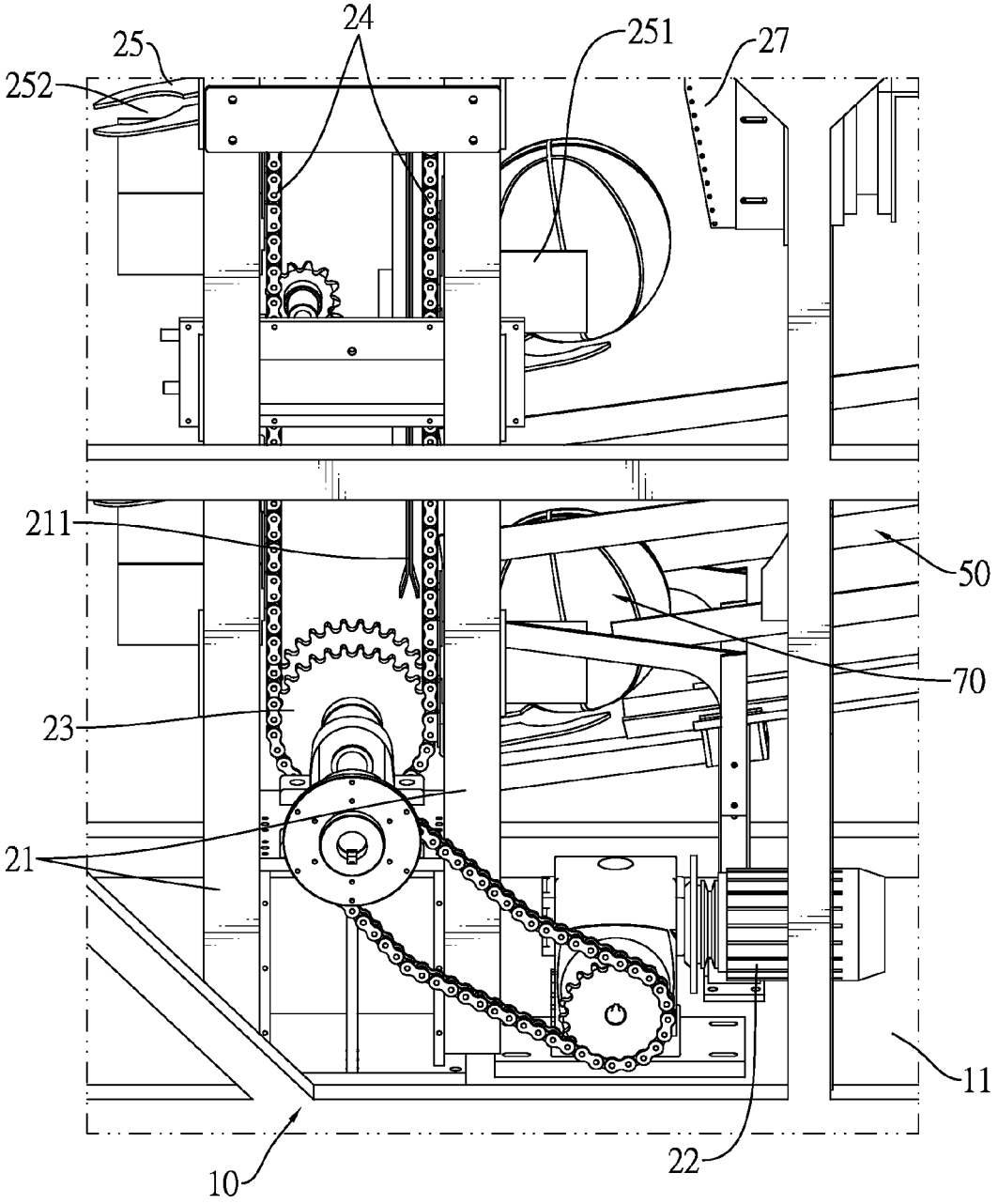
FIG. 2 is a rear view in partial section of a delivering mechanism of the basketball net testing device in FIG. 1.
Figure 3:
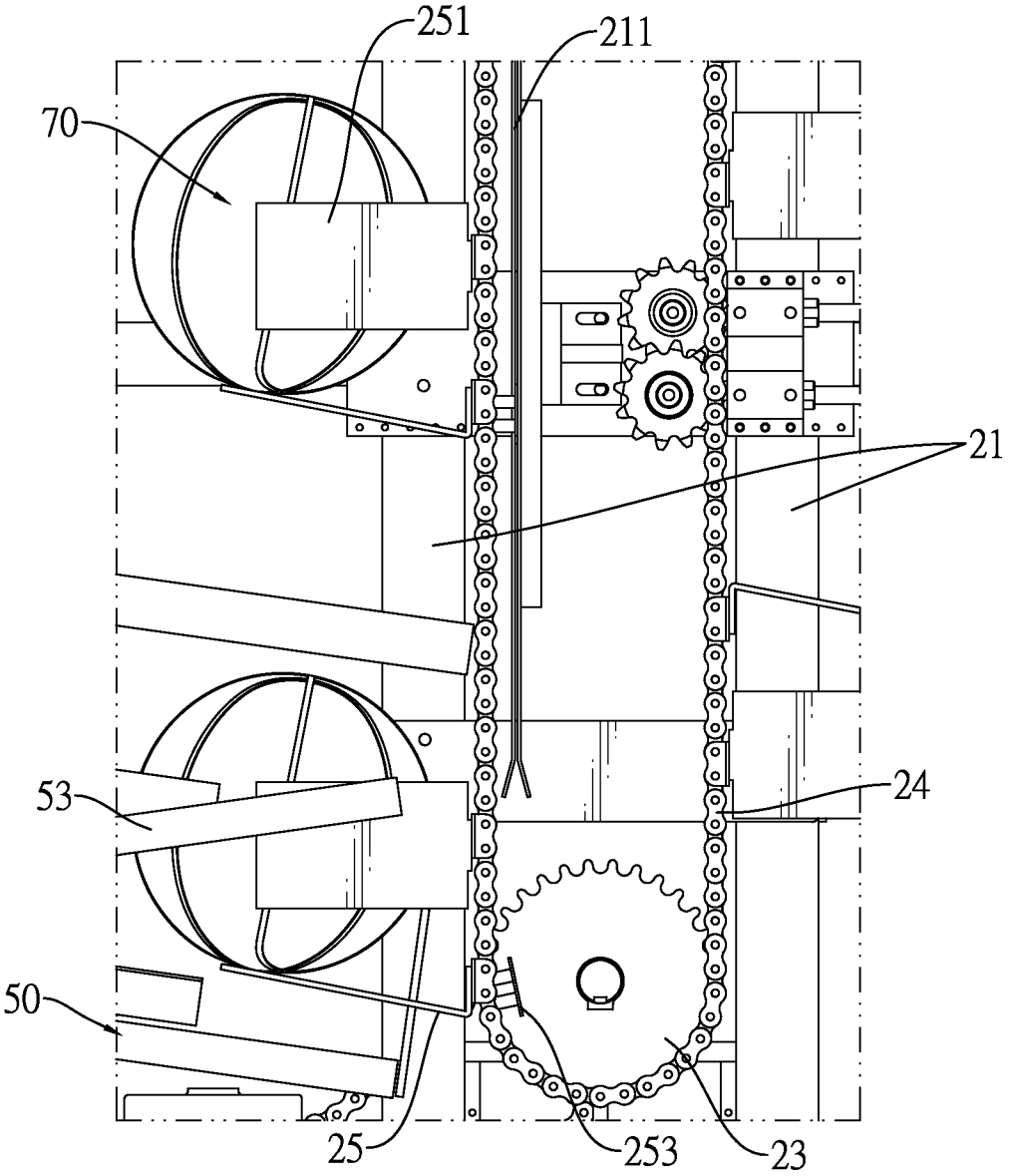
FIG. 3 is a front view in partial section of the delivering mechanism of the basketball net testing device in FIG. 1.

With reference to FIGS. 1 to 3, the delivering mechanism 20 is mounted in the mounting frame 10 and has a mounting panel 21, multiple pairs of elevating gears 23, multiple elevating chains 24, multiple ball seats 25, a first motor assembly 22, a pushing rod 26, and a fall prevention assembly 27.

The mounting panel 21 is disposed in the receiving space of the mounting frame 10, and is mounted on and protrudes up from the bottom panel 11 of the mounting frame 10. The mounting panel 21 has an upper end, a lower end, a side surface and a guiding track. The guiding track extends along a longitudinal direction of the basketball net testing device and is disposed on the side surface of the mounting panel 21. Preferably, the guiding track includes two guiding sheets 211. The guiding sheets 211 extend along the longitudinal direction of the basketball net testing device, are securely mounted parallelly on the side surface of the mounting panel 21, and are disposed apart from each other such that a clearance is defined between the guiding sheets 211.

The pairs of the elevating gears 23 are pivotally mounted on the mounting frame 10. The elevating gears 23 of each pair respectively correspond in position to the upper end and the lower end of the mounting panel 21. The elevating chains 24 are respectively mounted around and engage with the pairs of the elevating gears 23. Each of the elevating chains 24 has an outer peripheral edge. Specifically, the delivering mechanism 20 has two pairs of elevating gears 23 and two elevating chains 24.

The ball seats 25 are securely mounted separately on the outer peripheral edges of the elevating chains 24. Each ball seat 25 has a bottom, a back, two side panels 251, a bottom hole 252, and a shock absorbing sheet 253. The back of the ball seat 25 faces the elevating chains 24. The side panels 251 are disposed apart from each other. The bottom hole 252 is formed through the bottom of the ball seat 25 and is disposed between the side panels 251 of the ball seat 25. The shock absorbing sheet 253 is attached to the back of the ball seat 25 and selectively slides through the clearance between the guiding sheets 211 of the guiding track.

The first motor assembly 22 is securely mounted on the bottom panel 11 and is disposed beside the mounting panel 21. The first motor assembly 22 is connected to and selectively drives the elevating gears 23 and the elevating chains 24. Specifically, one of the elevating gears 23 of each pair is connected to the first motor assembly 22 and is selectively driven to rotate by the first motor assembly 22. When the first motor assembly 22 drives the elevating gears 23 to rotate, the other elevating gears 23 and the elevating chains 24 are driven accordingly, and the ball seats 25 move along with the elevating chains 24.

The pushing rod 26 is mounted on the top of the mounting frame 10 and extends obliquely toward a moving path along which the bottom holes 252 of the ball seats 25 move upward.

The fall prevention assembly 27 is elongated, extends along the longitudinal direction of the basketball net testing device, is mounted on the side panel 12 of the mounting frame 10, and has a lower end, a side surface, and an oblique guiding surface. The side surface of the fall prevention assembly 27 faces a moving path along which the ball seats 25 move upward. The oblique guiding surface of the fall prevention assembly 27 is formed on the lower end of the fall prevention assembly 27 and is contiguous to the side surface of the fall prevention assembly 27.

Figure 5:
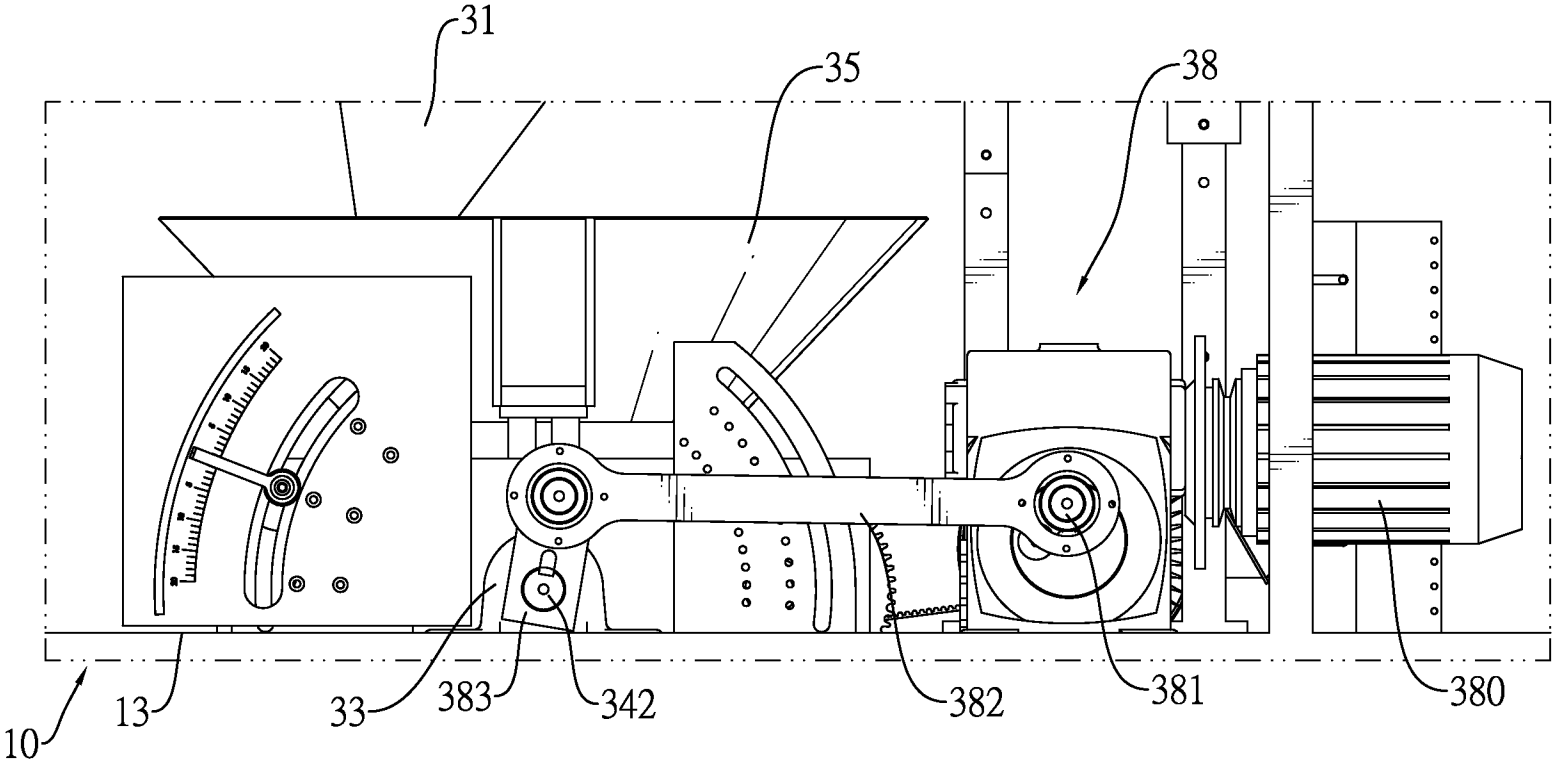
FIG. 5 is a front view in partial section of the shooting mechanism of the basketball net testing device in FIG. 1.

With reference to FIGS. 1, 4, and 5, the shooting mechanism 30 is mounted in the mounting frame 10 and has a guiding rail 31, a first fastening seat 32, a second fastening seat 33, two connecting panels 34, a guiding disc 35, two speeding rollers 36, a second motor assembly 37, and a third motor assembly 38.

The guiding rail 31 is securely mounted on the top panel 13 and has an output end and an input end. The input end corresponds in position to the pushing rod 26. Specifically, the guiding rail 31 includes multiple rods. The rods of the guiding rail 31 are separately disposed so as to form a channel that allows a ball to pass therethrough.

The first fastening seat 32 and the second fastening seat 33 are securely mounted on the top panel 13 and are oppositely disposed beside the output hole 131 of the top panel 13.

The connecting panels 34 are separately mounted above the top panel 13, are oppositely disposed beside the output hole 131 of the top panel 13, and are connected to each other via multiple connecting rods to form a frame. Each of the connecting panels 34 has a side surface and an upper edge. One of the connecting panels 34 is disposed adjacent to the first fastening seat 32 and has a first connecting shaft 341. The other connecting panel 34 is disposed adjacent to the second fastening seat 33 and has a second connecting shaft 342. The first connecting shaft 341 protrudes from the side surface of the connecting panel 34 and is pivotally connected to the first fastening seat 32. The second connecting shaft 342 protrudes from the side surface of the connecting panel 34 and is pivotally connected to the second fastening seat 33.

The guiding disc 35 is securely mounted on the upper edges of the connecting panels 34 and surrounds a conical space. The conical space has two opening ends respectively corresponding in position to the output end of the guiding rail 31 and the output hole 131 of the top panel 13.

The speeding rollers 36 are disposed apart from each other, and are mounted between and are pivotally connected to the connecting panels 34. A shooting output is defined between the speeding rollers 36. A width defined between the speeding rollers 36 corresponds to a width of the output hole 131 of the top panel 13. Each of the speeding rollers 36 has a roller shaft 361. The roller shaft 361 protrudes through the connecting panel 34 that is disposed adjacent to the first fastening seat 32.

The second motor assembly 37 is mounted on the top panel 13, is disposed adjacent to the first fastening seat 32 and selectively drives the speeding rollers 36 to rotate. The second motor assembly 37 has a motor 370, a double-layer driving wheel 371, a roller driving wheel 373, a transmission gear 374, a roller gear 374A, a first transmission member 372, and a second transmission member 372A.

The motor 370 of the second motor assembly 37 is securely mounted on the top panel 13 and has a power output end. The double-layer driving wheel 371 is rotatably mounted on and is coaxial with the first connecting shaft 341 and has two toothed peripheral surfaces. The roller driving wheel 373 is securely mounted on and is coaxial with one of the roller shafts 361. The transmission gear 374 is rotatably mounted on and is coaxial with the first connecting shaft 341 and is connected to the double-layer driving wheel 371. The roller gear 374A is securely mounted on and is coaxial with the other roller shaft 361 and engages with the transmission gear 374.

The first transmission member 372 is mounted around the power output end of the motor 370 of the second motor assembly 37 and one of the toothed peripheral surfaces of the double-layer driving wheel 371. The second transmission member 372A is mounted around the other toothed peripheral surface of the double-layer driving wheel 371 and the roller driving wheel 373. Specifically, the first transmission member 372 and the second transmission member 372A are transmission belts.

The first transmission member 372 is driven by the power output end of the motor 370 of the second motor assembly 37 and drives the double-layer driving wheel 371 to rotate. As the double-layer driving wheel 371 is driven to rotate, the second transmission member 372A drives the roller driving wheel 373 to rotate and the transmission gear 374 drives the roller gear 374A to rotate accordingly. Thus, the two speeding rollers 36 rotate in reverse directions.

The third motor assembly 38 is mounted on the top panel 13, is disposed adjacent to the second fastening seat 33, and selectively drives the connecting panels 34 to swing. The third motor assembly 38 has a motor 380, an eccentric shaft 381, a rotating panel 383, and a transmission shaft 382. The motor 380 of the third motor assembly 38 is securely mounted on the top panel 13 and has a power output end. The eccentric shaft 381 is connected to the power output end of the motor 380 of the third motor assembly 38 and is eccentric to a rotating center of the power output end of the motor 380 of the third motor assembly 38. A rotating path of the eccentric shaft 381 is annular. The rotating panel 383 has two ends. One of the ends of the rotating panel 383 is pivotally connected to the second connecting shaft 342. The transmission shaft 382 has two ends respectively connected pivotally to the other end of the rotating panel 383 and the eccentric shaft 381.

The power output end of the motor 380 of the third motor assembly 38 drives the eccentric shaft 381 to rotate along the annular rotating path. Then the eccentric shaft 381 drives the rotating panel 383 as well as the second connecting shaft 342 to rotate via the transmission shaft 382. Thus, an inclined angle of the shooting output defined between the speeding rollers 36 can be adjusted.

With reference to FIG. 1, the basketball hoop 40 is securely mounted on the mounting frame 10, and corresponds in position to and is disposed below the output hole 131 of the top panel 13. The basketball hoop 40 has a rim 42 and a basketball net 41. The basketball net 41 is attached to the rim 42.

The decelerating bracket 401 is securely mounted on the mounting frame 10 and is disposed below the basketball hoop 40. A diameter of the decelerating bracket 401 is larger than a diameter of the rim 42 of the basketball hoop 40.

With reference to FIG. 6, the returning mechanism 50 is mounted in the mounting frame 10, is mounted through the side panel 12, and corresponds in position to the returning hole 121 of the side panel 12. The returning mechanism 50 has a ball input and a ball output. The ball input is disposed below and corresponds in position to the basketball hoop 40. The ball output corresponds in position to the moving path along which the ball seats 25 move upward.

Specifically, the returning mechanism 50 has a guiding panel 53, a supporting bracket 51, and two guiding rods 52. The guiding panel 53 is annular, is mounted through the longitudinal slots 122 of the side panel 12, and has a ball input portion and a ball output portion. The ball input portion is disposed below and corresponds in position to the basketball hoop 40. The ball output portion corresponds in position to the moving path along which the ball seats 25 move upward. The ball input portion and the ball output portion respectively serve as the ball input and the ball output of the returning mechanism 50. The supporting bracket 51 is securely mounted on and protrudes up from the bottom panel 11 and supports the ball input portion of the guiding panel 53. The guiding rods 52 are mounted through the returning hole 121 of the side panel 12, are disposed apart from each other, and slant downwardly from the ball input portion to the ball output portion of the guiding panel 53. Each of the guiding rods 52 has an end connected to the supporting bracket 51.

With reference to FIG. 1, the controller 60 is mounted on the bottom panel 11 of the mounting frame 10. The controller 60 is electrically connected to the first motor assembly 22, the second motor assembly 37, and the third motor assembly 38, selectively drives the delivering mechanism 20 to deliver balls, and selectively drives the shooting mechanism 30 to speed up rotating of the speeding rollers 36 and to adjust the inclined angle of the shooting output defined between the speeding rollers 36.

With reference to FIGS. 1 and 2, when the basketball net testing device is under operation, multiple basketballs 70 are respectively mounted in the ball seats 25. When the first motor assembly 22 drives the elevating gears 23 and the elevating chains 24, the ball seats 25 as well as the basketballs 70 move in circulation.

With further reference to FIG. 3, as the ball seats 25 move upwardly, the shock absorbing sheets 253 of the ball seats 25 slide through the clearance between the guiding sheets 211. With the guiding sheets 211 holding the shock absorbing sheets 253, the elevating chains 24 do not sway and the ball seats 25 can move stably. Moreover, as the ball seats 25 move upwardly, the fall prevention assembly 27 restricts a displacement range of each basketball 70. Thus, the basketballs 70 do not drop from the ball seats 25. When the basketball 70 is delivered to a specific position, the pushing rod 26 pushes the basketball 70 to roll into the guiding rail 31. Then the basketball 70 drops from the output end of the guiding rail 31 to pass through the guiding disc 35 and the speeding rollers 36.

With further reference to FIG. 4, the speeding rollers 36 are driven to rotate by the second motor assembly 37 and rub against the basketball 70 to increase momentum of the basketball 70. Thus, the basketball 70 passes through the output hole 131 of the top panel 13 and is shot into the basketball hoop 40 to rub against the basketball net 41. The momentum of the basketball 70 when being shot is set according to rolling velocities of the speeding rollers 36. Therefore, the momentum of the basketball 70 can be controlled by the controller 60.

With further reference to FIG. 5, by controlling power output of the third motor assembly 38, the third motor assembly 38 sequentially drives the eccentric shaft 381, the transmission shaft 382, and the rotating panel 383 to rotate the second connecting shaft 342, the connecting panels 34, and the first connecting shaft 341 back and forth. Thus, the inclined angle of the shooting output defined between the speeding rollers 36 can be adjusted whenever necessary. Moreover, the controller 60 can drive the transmission shaft 382 and the rotating panel 383 to rotate the second connecting shaft 342 to stop the connecting panels 34 at a specific angle.

With further reference to FIG. 6, then the basketball 70 is shot through the basketball hoop 40 to rub against and hit the basketball net 41, is buffered by the decelerating bracket 401, and drops into the returning mechanism 50. The basketball 70 rolls on the guiding rods 52 of the returning mechanism 50 to pass through the returning hole 121 of the side panel 12. Afterwards, the basketball 70 rolls into one of the ball seats 25 of the delivering mechanism 20 in order to be used for testing durability of the basketball net 41 again.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A basketball net testing device comprising:

a mounting frame having a receiving space formed in the mounting frame;

a bottom panel transversely mounted at a bottom of the mounting frame;

a side panel mounted at the bottom of the mounting frame and on the bottom panel, dividing the receiving space, and having a returning hole; and a top panel transversely mounted at a top of the mounting frame and having an output hole;

a delivering mechanism mounted in the mounting frame and having a mounting panel disposed in the mounting frame, mounted on and protruding up from the bottom panel, and having an upper end and a lower end;

multiple pairs of elevating gears pivotally mounted on the mounting frame, and the elevating gears of each pair respectively corresponding in position to the upper end and the lower end of the mounting panel;

multiple elevating chains respectively mounted around and engaging with the pairs of the elevating gears, and each of the elevating chains having an outer peripheral edge;

multiple ball seats securely mounted separately on the outer peripheral edges of the elevating chains;

a first motor assembly disposed beside the mounting panel, and connected to and selectively driving the elevating gears and the elevating chains;

a pushing rod mounted on the top of the mounting frame and extending obliquely;

a shooting mechanism mounted in the mounting frame and having a guiding rail securely mounted on the top panel and having an output end; and an input end corresponding in position to the pushing rod;

two connecting panels separately mounted above the top panel, and oppositely disposed beside the output hole of the top panel, and each of the connecting panels having an upper edge;

a guiding disc securely mounted on the upper edges of the connecting panels;

two speeding rollers disposed apart from each other, mounted between and pivotally connected to the connecting panels, and a width defined between the speeding rollers corresponding to a width of the output hole of the top panel; and a second motor assembly mounted on the top panel and selectively driving the speeding rollers to rotate;

a basketball hoop securely mounted on the mounting frame, and corresponding in position to and disposed below the output hole of the top panel;

a returning mechanism mounted in the mounting frame, mounted through the side panel, and corresponding in position to the returning hole of the side panel, and the returning mechanism having a ball input disposed below and corresponding in position to the basketball hoop; and a ball output corresponding in position to a moving path along which the ball seats move upward; and a controller mounted on the bottom panel of the mounting frame, and electrically connected to the first motor assembly and the second motor assembly.

2. The basketball net testing device as claimed in claim 1, wherein the shooting mechanism further has a first fastening seat; and a second fastening seat, the first fastening seat and the second fastening seat securely mounted on the top panel and oppositely disposed beside the output hole of the top panel; and the connecting panels of the shooting mechanism are connected to each other via multiple connecting rods to form a frame, each of the connecting panels has a side surface, one of the connecting panels is disposed adjacent to the first fastening seat and has a first connecting shaft, the other connecting panel is disposed adjacent to the second fastening seat and has a second connecting shaft, the first connecting shaft protrudes from the side surface of the connecting panel and is pivotally connected to the first fastening seat, and the second connecting shaft protrudes from the side surface of the connecting panel and is pivotally connected to the second fastening seat;

each of the speeding rollers of the shooting mechanism has a roller shaft protruding through the connecting panel that is disposed adjacent to the first fastening seat; and the shooting mechanism further has a third motor assembly mounted on the top panel, disposed adjacent to the second fastening seat, and having a motor securely mounted on the top panel and having a power output end;

an eccentric shaft connected to the power output end of the motor of the third motor assembly and being eccentric to a rotating center of the power output end of the motor of the third motor assembly;

a rotating panel having two ends, and one of the ends of the rotating panel pivotally connected to the second connecting shaft; and a transmission shaft having two ends respectively connected pivotally to the other end of the rotating panel and the eccentric shaft.

3. The basketball net testing device as claimed in claim 2, wherein the second motor assembly has a motor securely mounted on the top panel and having a power output end;

a double-layer driving wheel rotatably mounted on and being coaxial with the first connecting shaft and having two toothed peripheral surfaces;

a roller driving wheel securely mounted on and being coaxial with one of the roller shafts;

a transmission gear rotatably mounted on and being coaxial with the first connecting shaft and connected to the double-layer driving wheel;

a roller gear securely mounted on and being coaxial with the other roller shaft and engaging with the transmission gear;

a first transmission member mounted around the power output end of the motor of the second motor assembly and one of the toothed peripheral surfaces of the double-layer driving wheel; and a second transmission member mounted around the other toothed peripheral surface of the double-layer driving wheel and the roller driving wheel.

4. The basketball net testing device as claimed in claim 3, wherein the returning mechanism has a guiding panel mounted through longitudinal slots of the side panel and having a ball input portion disposed below and corresponding in position to the basketball hoop; and a ball output portion corresponding in position to the moving path along which the ball seats move upward;

a supporting bracket securely mounted on and protruding up from the bottom panel, and supporting the guiding panel; and two guiding rods mounted through the returning hole of the side panel, disposed apart from each other, and slanting downwardly from the ball input portion to the ball output portion of the guiding panel, and each of the guiding rods having an end connected to the supporting bracket.

5. The basketball net testing device as claimed in claim 4, wherein the mounting panel of the delivering mechanism further has a side surface; and two guiding sheets extending along a longitudinal direction of the basketball net testing device, securely mounted parallelly on the side surface of the mounting panel, and disposed apart from each other such that a clearance is defined between the guiding sheets;

each ball seat of the delivering mechanism has a bottom;

a back facing the elevating chains;

two side panels disposed apart from each other;

a bottom hole formed through the bottom of the ball seat and disposed between the side panels of the ball seat; and a shock absorbing sheet attached to the back of the ball seat and selectively sliding through the clearance between the guiding sheets; and the pushing rod of the delivering mechanism extends obliquely toward a moving path along which the bottom holes of the ball seats move upward.

6. The basketball net testing device as claimed in claim 5 further comprising a decelerating bracket securely mounted on the mounting frame and disposed below the basketball hoop, and a diameter of the decelerating bracket being larger than a diameter of a rim of the basketball hoop.

7. The basketball net testing device as claimed in claim 6, wherein the delivering mechanism further has a fall prevention assembly being elongated, extending along the longitudinal direction of the basketball net testing device, mounted on the side panel of the mounting frame, and having a lower end;

a side surface facing the moving path along which the ball seats move upward; and an oblique guiding surface formed on the lower end of the fall prevention assembly and being contiguous to the side surface of the fall prevention assembly.

8. The basketball net testing device as claimed in claim 3, wherein the mounting panel of the delivering mechanism further has a side surface; and two guiding sheets extending along a longitudinal direction of the basketball net testing device, securely mounted parallelly on the side surface of the mounting panel, and disposed apart from each other such that a clearance is defined between the guiding sheets;

each ball seat of the delivering mechanism has a bottom;

a back facing the elevating chains;

two side panels disposed apart from each other;

a bottom hole formed through the bottom of the ball seat and disposed between the side panels of the ball seat; and a shock absorbing sheet attached to the back of the ball seat and selectively sliding through the clearance between the guiding sheets; and the pushing rod of the delivering mechanism extends obliquely toward a moving path along which the bottom holes of the ball seats move upward.

9. The basketball net testing device as claimed in claim 8 further comprising a decelerating bracket securely mounted on the mounting frame and disposed below the basketball hoop, and a diameter of the decelerating bracket being larger than a diameter of a rim of the basketball hoop.

10. The basketball net testing device as claimed in claim 9, wherein the delivering mechanism further has a fall prevention assembly being elongated, extending along the longitudinal direction of the basketball net testing device, mounted on the side panel of the mounting frame, and having a lower end;

a side surface facing the moving path along which the ball seats move upward; and an oblique guiding surface formed on the lower end of the fall prevention assembly and being contiguous to the side surface of the fall prevention assembly.

11. The basketball net testing device as claimed in claim 2, wherein the returning mechanism has a guiding panel mounted through longitudinal slots of the side panel and having a ball input portion disposed below and corresponding in position to the basketball hoop; and a ball output portion corresponding in position to the moving path along which the ball seats move upward;

a supporting bracket securely mounted on and protruding up from the bottom panel, and supporting the guiding panel; and two guiding rods mounted through the returning hole of the side panel, disposed apart from each other, and slanting downwardly from the ball input portion to the ball output portion of the guiding panel, and each of the guiding rods having an end connected to the supporting bracket.

12. The basketball net testing device as claimed in claim 11, wherein the mounting panel of the delivering mechanism further has a side surface; and two guiding sheets extending along a longitudinal direction of the basketball net testing device, securely mounted parallelly on the side surface of the mounting panel, and disposed apart from each other such that a clearance is defined between the guiding sheets;

each ball seat of the delivering mechanism has a bottom;

a back facing the elevating chains;

two side panels disposed apart from each other;

a bottom hole formed through the bottom of the ball seat and disposed between the side panels of the ball seat; and a shock absorbing sheet attached to the back of the ball seat and selectively sliding through the clearance between the guiding sheets; and the pushing rod of the delivering mechanism extends obliquely toward a moving path along which of the bottom holes of the ball seats move upward.

13. The basketball net testing device as claimed in claim 2, wherein the mounting panel of the delivering mechanism further has a side surface; and two guiding sheets extending along a longitudinal direction of the basketball net testing device, securely mounted parallelly on the side surface of the mounting panel, and disposed apart from each other such that a clearance is defined between the guiding sheets;

each ball seat of the delivering mechanism has a bottom;

a back facing the elevating chains;

two side panels disposed apart from each other;

a bottom hole formed through the bottom of the ball seat and disposed between the side panels of the ball seat; and a shock absorbing sheet attached to the back of the ball seat and selectively sliding through the clearance between the guiding sheets; and the pushing rod of the delivering mechanism extends obliquely toward a moving path along which the bottom holes of the ball seats move upward.

14. The basketball net testing device as claimed in claim 1, wherein the returning mechanism has a guiding panel mounted through longitudinal slots of the side panel and having a ball input portion disposed below and corresponding in position to the basketball hoop; and a ball output portion corresponding in position to the moving path along which the ball seats move upward;

a supporting bracket securely mounted on and protruding up from the bottom panel, and supporting the guiding panel; and two guiding rods mounted through the returning hole of the side panel, disposed apart from each other, and slanting downwardly from the ball input portion to the ball output portion of the guiding panel, and each of the guiding rods having an end connected to the supporting bracket.

15. The basketball net testing device as claimed in claim 14, wherein the mounting panel of the delivering mechanism further has a side surface; and two guiding sheets extending along a longitudinal direction of the basketball net testing device, securely mounted parallelly on the side surface of the mounting panel, and disposed apart from each other such that a clearance is defined between the guiding sheets;

each ball seat of the delivering mechanism has a bottom;

a back facing the elevating chains;

two side panels disposed apart from each other;

a bottom hole formed through the bottom of the ball seat and disposed between the side panels of the ball seat; and a shock absorbing sheet attached to the back of the ball seat and selectively sliding through the clearance between the guiding sheets; and the pushing rod of the delivering mechanism extends obliquely toward a moving path along which the bottom holes of the ball seats move upward.

16. The basketball net testing device as claimed in claim 15 further comprising a decelerating bracket securely mounted on the mounting frame and disposed below the basketball hoop, and a diameter of the decelerating bracket being larger than a diameter of a rim of the basketball hoop.

17. The basketball net testing device as claimed in claim 16, wherein the delivering mechanism further has a fall prevention assembly being elongated, extending along the longitudinal direction of the basketball net testing device, mounted on the side panel of the mounting frame, and having a lower end;

a side surface facing the moving path along which the ball seats move upward; and an oblique guiding surface formed on the lower end of the fall prevention assembly and being contiguous to the side surface of the fall prevention assembly.

18. The basketball net testing device as claimed in claim 1, wherein the mounting panel of the delivering mechanism further has a side surface; and two guiding sheets extending along a longitudinal direction of the basketball net testing device, securely mounted parallelly on the side surface of the mounting panel, and disposed apart from each other such that a clearance is defined between the guiding sheets;

each ball seat of the delivering mechanism has a bottom;

a back facing the elevating chains;

two side panels disposed apart from each other;

a bottom hole formed through the bottom of the ball seat and disposed between the side panels of the ball seat; and a shock absorbing sheet attached to the back of the ball seat and selectively sliding through the clearance between the guiding sheets; and the pushing rod of the delivering mechanism extends obliquely toward a moving path along which the bottom holes of the ball seats move upward.

19. The basketball net testing device as claimed in claim 18 further comprising a decelerating bracket securely mounted on the mounting frame and disposed below the basketball hoop, and a diameter of the decelerating bracket being larger than a diameter of a rim of the basketball hoop.

20. The basketball net testing device as claimed in claim 19, wherein the delivering mechanism further has a fall prevention assembly being elongated, extending along the longitudinal direction of the basketball net testing device, mounted on the side panel of the mounting frame, and having a lower end;

a side surface facing the moving path along which the ball seats move upward; and an oblique guiding surface formed on the lower end of the fall prevention assembly and being contiguous to the side surface of the fall prevention assembly.

* * * * *